United States Patent [19]

Tateno et al.

[11] 4,044,736

[45] Aug. 30, 1977

[54] DEVICE FOR CONTROLLING A CHOKE VALVE IN A CARBURETOR

[75] Inventors: Hidenori Tateno, Nagoya; Toshiro Yoshida; Koichi Hirasawa, both of Toyota, all of Japan

[73] Assignee: Toyota Jidosha Kogyo Kabushiki Kaisha, Japan

[21] Appl. No.: 489,492

[22] Filed: July 18, 1974

[30] Foreign Application Priority Data

July 18, 1973 Japan ..... 48-80248

[51] Int. Cl.[2] ..... F02D 11/08

[52] U.S. Cl. ..... 123/119 F; 261/39 E

[58] Field of Search ..... 123/119 F, 124 B; 261/39 B, 39 E

[56] References Cited

U.S. PATENT DOCUMENTS

| | | | |
|---|---|---|---|
| 3,043,286 | 7/1962 | Blomberg | 123/124 B |
| 3,699,937 | 10/1972 | DePetris | 123/119 F |
| 3,752,133 | 8/1973 | Irish et al. | 123/119 F |
| 3,789,813 | 2/1974 | Hunt | 123/119 F |
| 3,800,762 | 4/1974 | McCullough | 123/119 F |
| 3,800,767 | 4/1974 | Winkley | 123/119 F |
| 3,831,909 | 8/1974 | Freismuth | 123/119 F |
| 3,905,346 | 9/1975 | Freismuth et al. | 261/39 B |

FOREIGN PATENT DOCUMENTS

| | | | |
|---|---|---|---|
| 913,173 | 12/1962 | United Kingdom | 123/119 F |

*Primary Examiner*—Carroll B. Dority, Jr.
*Assistant Examiner*—David D. Reynolds
*Attorney, Agent, or Firm*—Toren, McGeady and Stanger

[57] ABSTRACT

In an automatic choke valve for an internal combustion engine the extent to which the choke valve is opened is controlled by a bimetal member located in a casing separate from the carburetor through which air is passed whose temperature is determined by the temperature of the engine. In addition, a heater unit is positioned in the casing for supplying heat to the bimetal member and the heater unit is controlled by switches operated by the engine temperature and by the atmospheric pressure around the engine.

4 Claims, 1 Drawing Figure

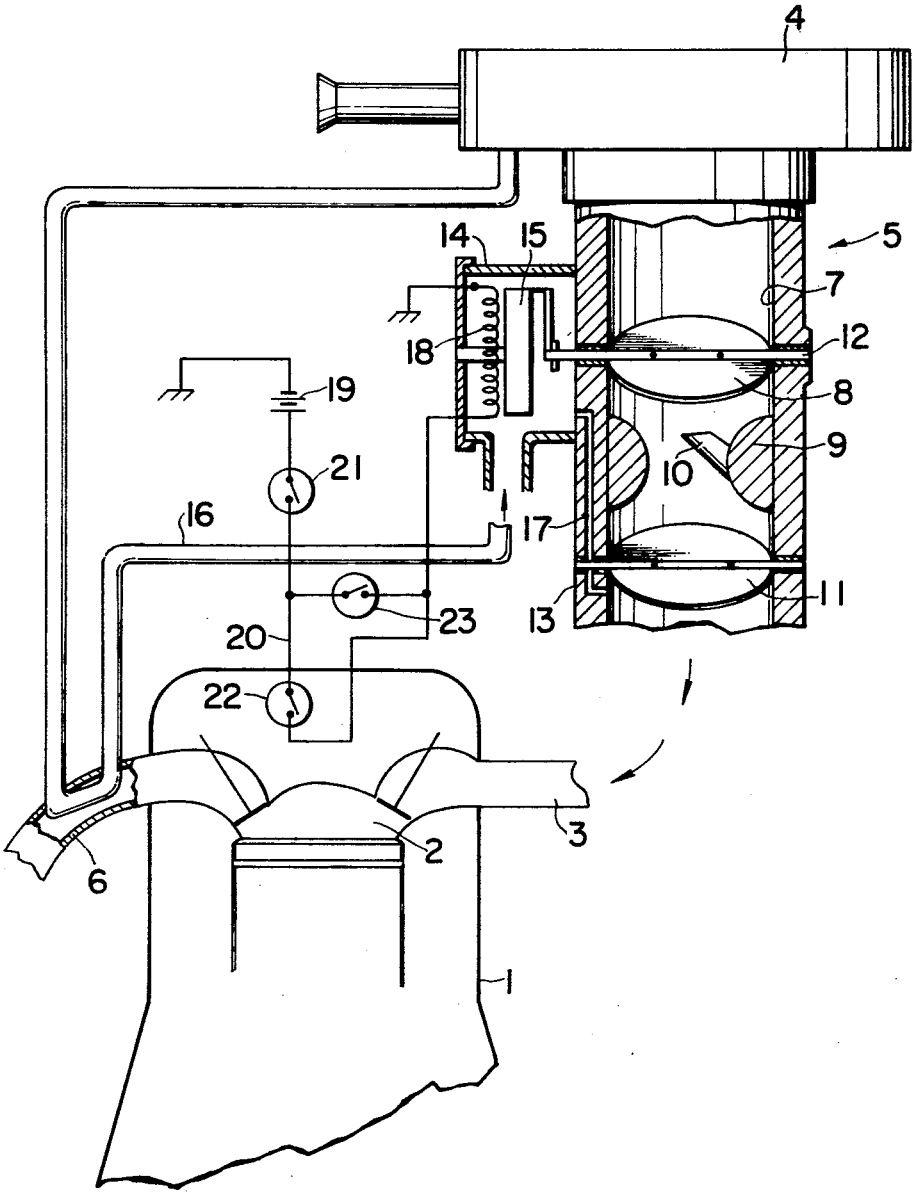
4
5
7
12
8
9
10
11
13
14
15
18
17
19
21
16
23
20
22
3
2
6
1

DEVICE FOR CONTROLLING A CHOKE VALVE IN A CARBURETOR

BACKGROUND OF THE INVENTION

The present invention is directed to an automatic choke unit for an internal combustion engine and, more particularly, it is directed to a control arrangement for maintaining the position of the choke valve so that the optimum volume of air is supplied to the venturi in a carburetor depending both on engine temperature and the ambient atmospheric pressure about the engine.

In conventional automatic choke units, a bimetal member for controlling the choke valve is generally located within a casing into which air is passed which has been heated by the exhaust gas from the engine and is drawn into the casing by the negative pressure in the engine intake system. As the bimetal member is heated by the air flowing into the casing, it controls the extent to which the choke valve is opened. However, if a vehicle containing such an automatic choke unit runs up a long hill, or if the vehicle continues to run at high speed or when its engine is running at full or high load, the negative pressure in the intake system drops and, as a result, the warm air passing into the casing decreases in volume and the temperature in the casing drops off. As the temperature in the casing drops, the bimetal member cools off and the choke valve is displaced toward the closed position even though the engine is sufficiently warmed-up. As a result, the air-fuel ratio becomes enriched and engine operation is adversely affected, fuel consumption is increased, and the pollutants or contaminants in the exhaust gas are also increased.

Furthermore, these conventional automatic choke units are arranged to increase the air-fuel ratio before the engine is sufficiently warmed-up so that positive startup and smooth running of the engine is attained. However, when a vehicle is running at a high elevation, the ambient atmospheric pressure drops and the air-fuel ratio tends to become enriched. Moreover, when the engine is running, its output drops so that the engine must run at a higher load than at which it runs under normal atmospheric pressure. Accordingly, the negative pressure in the intake system drops and the amount of warm air flowing into the casing decreases in volume. Under such conditions, the bimetal member cools off even though the engine is sufficiently warmed-up and the choke valve is moved toward the closed position. Further, the conventional choke units cannot control the air-fuel ratio in dependence on the temperature of the engine whereby the engine operation is adversely affected.

SUMMARY OF THE INVENTION

It is the primary object of the present invention to provide a control arrangement for assuring an adequate air-fuel ratio for internal combustion engine operation regardless of the effect of engine operating conditions and ambient atmospheric pressure conditions on the operation of the automatic choke unit.

In accordance with the present invention, a temperature drop in the bimetal member can be prevented where it might normally occur when the engine is running at full load after it has warmed-up or the engine is operating under reduced atmospheric pressure conditions so that the optimum air-fuel ratio is continuously supplied to the combustion chambers in the engine. To overcome any temperature drop affecting the bimetal member, a heater is positioned within the casing and is connected to a power source through a pair of switches arranged in parallel, one switch being operable in response to the temperature of the engine and the other being operable in response to reduced atmospheric pressure conditions to assure proper regulation of the choke valve.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there is illustrated and described a preferred embodiment of the invention.

BRIEF DESCRIPTION OF THE DRAWING

The drawing is a diagrammatic view of an automatic choke unit for regulating the air-fuel ratio introduced into an internal combustion engine.

DETAILED DESCRIPTION OF THE INVENTION

In the drawing an internal combustion engine 1 is illustrated containing combustion chambers 2 to which a fuel-air mixture is supplied through an intake manifold 3 from an air cleaner 4 and a carburetor 5. After combustion, exhaust gases are discharged from the chambers 2 through an exhaust manifold 6 into the surrounding atmosphere. The carburetor 5 consists of a carburetor barrel or housing 13 extending downwardly from the air cleaner and forming a fuel-air mixing chamber or passage 7. Within the fuel-air mixing chamber 7, a choke valve 8, mounted on a shaft 12, controls the flow of air received from the air cleaner. Below or downstream from the choke valve 8 is a venturi 9 with a nozzle 10 located at the venturi for discharging fuel into the chamber. A throttle valve 11 is positioned below the venturi 9 for controlling the flow rate of the fuel-air mixture to the combustion chambers. The shaft 12 on which the choke valve is mounted is supported in the housing 13 and extends outwardly from one side of the housing. As shown schematically, a casing 14 is mounted on one side of the housing 13 and the shaft 12 extends into the casing and is connected to one end of a bimetal spring 15 supported within the casing. The rotary shaft 12 for the choke valve 8 is connected to the bimetal spring 15 so that the choke valve is closed when the bimetal spring is cold and the choke valve gradually opens as the spring is heated within the casing.

A tube 16 extends from the air cleaner 4 for supplying air into the casing 14. For a portion of its path, the tube 16 is positioned within the exhaust manifold 6 so that the air flowing to the casing is heated in accordance with the temperature of the exhaust gases flowing through the manifold. In addition, a passage 17 is formed by the housing 13 and extends between the casing 14 and the downstream side of the throttle valve 11. Accordingly, based on the negative pressure at the downstream side of the throttle valve 11 the amount of air drawn into the casing 14 is regulated.

In addition to the bimetal spring 15, a heater 18 is positioned within the casing and is connected over a wire 20 to a battery 19. An ignition switch 21 is positioned in the wire 20 and the switch is closed when the engine is started up. Furthermore, a temperature sensitive switch 22, which is mounted on the engine 1, is positioned in the wire 20 between the ignition switch 21 and the heater. When the engine has warmed-up, for instance, when the cooling water in the engine has reached a predetermined temperature, the temperature sensitive switch closes so that the heater 18 is electrically connected to the battery through the ignition switch 21 and the switch 22 for supplying electric current to the heater. In addition, an atmospheric pressure sensitive switch 23 is arranged in the line 20 in parallel with the temperature sensitive switch 22. The atmospheric pressure sensitive switch 23 is located adjacent to the engine. When the ambient atmospheric pressure drops below a certain level, the switch is closed and the heater is electrically connected to the battery 19 through the ignition switch 21 and the pressure sensing switch 23.

The automatic choke unit operates in the following manner.

When a vehicle incorporating the internal combustion engine 1 and automatic choke unit shown in the drawing is travelling over a level road with the engine in a cold condition, the air which flows into the casing through the tube 16 from the air cleaner under the effect of the negative pressure in the intake manifold 3, is cold and, as a result, the bimetal spring 15 is not heated and the choke valve 8 remains closed. With the choke valve closed, an enriched fuel-air mixture is introduced through the intake manifold 3 into the combustion chambers 2 of the engine 1. As the engine continues to run it begins to warm-up and the air flowing through the tube 16 into the casing 14 is also warmed-up as it passes through the exhaust manifold 6. The heated air entering the casing heats the bimetal spring 15 and the choke valve 8 commences to open. When the engine warm-up has reached a certain point, the temperature sensitive switch 22 mounted on the engine is displaced into the closed position so that the heater 18 is connected to the battery 19 and receives electric current. Under these conditions, the interior of the casing is heated not only by the air conveyed through the tube 16 but also by the heater 18. When the vehicle runs continuously up a long hill or when it continues to run at a high speed or when its engine is running at full or high load, the negative pressure in the intake manifold drops off and the volume of heated air flowing into the casing is reduced. However, since the engine has been warmed-up, the temperature switch 22 remains closed and electric current flows from the battery 19 to the heater 18 and, as a result, the space within the casing remains heated. The heat within the casing maintains the heated condition of the bimetal spring 15 and the choke valve remains in its opened position. Therefore, the fuel-air mixture ratio is maintained at a suitable level.

If the vehicle is running at a high elevation, the ambient atmospheric pressure drops and when it reaches a certain level the atmospheric pressure sensitive switch 23 is closed. With switch 23 closed, the heater 18 is connected to the battery 19 through the ignition switch and the casing remains heated. Therefore, the bimetal spring 15 is heated not only by the air flowing into the casing 14 through the tube 16 but also by the heater 18. Accordingly, the choke valve 8 is opened sooner than when the vehicle is running at a lower elevation and the air-fuel ratio becomes thinner than when the vehicle is running under normal atmospheric pressure conditions.

In accordance with the present invention, the bimetal spring is heated by the heater when the engine is warmed-up so that the temperature of the bimetal spring will not drop even if it is not heated by the air usually supplied through the tube 16. Accordingly, if the bimetal spring remains heated, the choke valve remains in its opened condition and the optimum air-fuel ratio supplied to the engine can be maintained. Therefore, the engine can run under optimum operating conditions, the amount of pollutants or contaminants in the exhaust gas can be minimized, and considerable fuel economy is attained.

When the vehicle is operating under reduced atmospheric pressure conditions, that is, below normal atmospheric pressure conditions, the bimetal spring is heated not only by the air but also by the heater so that the air-fuel ratio best suited to the drop in atmospheric pressure can be obtained. Thus, under these circumstances, the engine can continue to run at optimum operating conditions.

While a specific embodiment of the invention has been shown and described in detail to illustrate the application of the inventive principles, it will be understood that the invention may be embodied otherwise without departing from such principles.

What is claimed is:

1. In an internal combustion engine, an automatic choke unit including an air cleaner, a carburetor arranged to be connected to said air cleaner, a venturi located in said carburetor, a choke valve positioned within said carburetor between said venturi and the connection of said carburetor to said air cleaner for controlling the flow of air to said venturi, a casing located exteriorly of and mounted on said carburetor, a bimetal member positioned within said casing and connected to said choke valve so that said bimetal member controls the opening and closing of said choke valve as the temperature level within the casing rises and falls, a flow passageway for introducing a flow of air into said casing, said flow passageway arranged to be heated by the internal combustion engine so that as the engine warms-up said flow passageway delivers heated air into said casing, means connected to the interior of said casing for drawing air through said flow passageway into said casing, a heater unit positioned within said casing and arranged to supply heat to said bimetal member, means for generating heat within said heater unit including a first actuating means for commencing the operation of said heater unit only after the internal combustion engine has reached a predetermined warm-up level, wherein the improvement comprises that said means for generating heat includes second actuating means for commencing the operation of said heater unit when the ambient atmospheric pressure surrounding the exterior of the internal combustion engine drops below a predetermined level, said second actuating means located adjacent to and exteriorly of said engine and being separate from and spaced from both said carburetor and said casing containing said bimetal member for directly sensing the ambient atmospheric pressure outside the engine so that the ambient atmospheric pressure is the sole control of said second actuating means which controls the operation of said heater unit, and said flow passageway having an inlet end connected to said air cleaner for flowing a part of the intake air from said air cleaner through said flow passageway for introduction into said casing.

2. In an internal combustion engine, an automatic choke unit, as set forth in claim 1, wherein said means for generating heat comprises a battery, a wire connecting said battery to said heater unit, and said first actuating means comprises a first switch positioned in said wire between said battery and said heater unit, said first switch having an open position and a closed position in said wire between said battery and said heater unit, said first switch having an open position and a closed position and arranged to be displaced from the open position blocking the flow of electric current to said heater unit to the closed position for passing electric current from said battery to said heater unit when the internal combustion engine temperature reaches a predetermined level during warm-up.

3. In an internal combustion engine, an automatic choke unit including a carburetor arranged to be connected to a source of air, a venturi located in said carburetor, a choke valve positioned within said carburetor between said venturi and the connection of said carburetor to the source of air for controlling the flow of air to said venturi, a casing located exteriorly of said carburetor, a bimetal member positioned within said casing and connected to said choke valve so that said bimetal member controls the opening and closing of said choke valve as the temperature level within the casing rises and falls, a flow passageway for introducing a flow of air into said casing, said flow passageway arranged to be heated by the internal combustion engine so that as the engine warms-up said flow passageway delivers heated air into said casing, means connected to the interior of said casing for drawing air through said flow passageway into said casing, a heater unit positioned within said casing and arranged to supply heat to said bimetal member, means for generating heat within said heater in response to the internal combustion engine having reached a predetermined warm-up level, wherein the improvement comprises that said means for generating heat comprises a battery, a wire connecting said battery to said heater unit, a first switch positioned in said wire between said battery and said heater unit, said first switch having an open position and a closed position and arranged to be displaced from the open position blocking the flow of electric current to said heater unit to the closed position for passing electric current from said battery to said heater unit when the internal combustion engine temperature reaches a predetermined level during warm-up, a second switch located in said wire parallel with said first switch, said second switch located adjacent to and exteriorly of said engine and being separate from and spaced from both said carburetor and said casing containing said bimetal member for directly sensing the ambient atmospheric pressure outside the engine, said second switch having an open position and a closed position and arranged to be displaced from the open position blocking the flow of electric current to said heater unit to the closed position for passing electric current from said battery to said heater unit when the ambient atmospheric pressure surrounding the internal combustion engine drops below a predetermined level so that the ambient atmospheric pressure is the sole control of said second switch which controls the operation of said heater unit.

4. In an internal combustion engine, an automatic choke unit, as set forth in claim 3, wherein a third switch is located in said wire between said first and second switches and said battery and is arranged to be placed in the closed position when the internal combustion engine is started up.

* * * * *